US006843006B1

(12) United States Patent
Montgomery

(10) Patent No.: US 6,843,006 B1
(45) Date of Patent: Jan. 18, 2005

(54) DITCH DIGGER

(76) Inventor: Christopher Lee Montgomery, 7325 Laird St., Panama City Beach, FL (US) 32408

( * ) Notice: Subject to any disclaimer, the term of this patent is extended or adjusted under 35 U.S.C. 154(b) by 0 days.

(21) Appl. No.: 10/442,869

(22) Filed: May 20, 2003

(51) Int. Cl.[7] ..... A01B 31/00; E02F 9/28
(52) U.S. Cl. ..... 37/465; 172/684.5
(58) Field of Search ..... 172/681–683, 172/677, 699, 439, 799.5, 810, 811, 684.5, 47, 238, 240, 452, 272; 37/465, 197, 232, 268, 270

(56) References Cited

U.S. PATENT DOCUMENTS 1,490,502 A * 4/1924 Barnhart ..... 172/605
4,114,391 A * 9/1978 Kahley, Sr. ..... 111/199
5,046,271 A * 9/1991 Daniels ..... 37/231
5,595,007 A * 1/1997 Biance ..... 37/268
5,984,613 A * 11/1999 Motilewa ..... 414/462
6,293,351 B1 * 9/2001 Schmidt ..... 172/439
6,453,582 B1 * 9/2002 Fulton, III ..... 37/197

* cited by examiner

*Primary Examiner*—Robert E Pezzuto
(74) *Attorney, Agent, or Firm*—Peter Loffler

(57) ABSTRACT

A ditch digger is attached to the square hitch located proximate the rear bumper of a vehicle and uses a stock member that has a first section and an angled second section. A plurality of openings are located along the first section whereby a connector is attached to the stock member by passing a pin through openings on the connector and on the stock member. The connector also attaches to the vehicle. A furrowing blade is attached to the second section of the stock member as is a loop member to which electrical conduit and the like may be attached.

13 Claims, 3 Drawing Sheets

DITCH DIGGER

BACKGROUND OF THE INVENTION

1. Field of the Invention

The present invention relates to ditch digger that is attached to a square hitch that is itself-attached to a vehicle proximate the rear bumper of the vehicle, wherein the vehicle provides the locomotion power for driving the ditch digger through the earth.

2. Background of the Prior Art

Although the practice of bringing electrical service to a new construction building overhead is still employed, modern practices tend to favor the bringing of the electrical service to the building in subterranean fashion. This is especially true when constructing a subdivision or in commercial construction applications. In order to bring the electrical service from the point of supply provided by the electricity provider to the building itself, a ditch is dug and the wiring conduit placed therein, after which, the ditch is filled thereby burying the conduit. Typically, this is accomplished by the contractor using an appropriate ditch digging machine wherein an operator guides the ditch digging machine along the desired path, the ditch digging machine creating the ditch as the machine moves along the path.

The problems with this tried and true method is that, due to the relatively high cost of such ditch digging machines, many contractors and subcontractors rent such machines per job, which rental adds to the overall cost of the construction project. Additionally, there are associated costs with bringing the machine between the rental house and the job site, further increasing construction job costs, and due to scheduling imbalances, possibly adding to project delay. In order to overcome these problems, many large contractors purchase a ditch digging machine. However, such machines are expensive to acquire and are also expensive to operate and maintain. As such machines serve but a limited function, they tend to be idle which tends to be an inefficient use of such a capital item. Additionally, such ditch digging machines, due to their relatively complex design and the harsh environment in which they operate, tend to break down on a frequent basis. Furthermore, the prior art devices can be quite dangerous to operate especially if the contractor is using a relatively new and inexperienced employee.

Therefore, there exists a need in the art for a ditch digger that overcomes the above-stated problems in the art. Specifically, such a ditch digger must be of relatively simple design and construction so that the device is not unduly expensive, allowing small contractors and subcontractors to purchase such a device. This will allow the contractors and subcontractors to have the machine readily available without the attendant costs of transporting the device between the rental house and the job site and without the worry of having a large piece of capital equipment sitting idle when the device is not in use. Such a ditch digging device must be of relatively simple construction and must be relatively easy to maintain such that the device does not suffer frequent breakdowns and the device must be relatively safe to operate even by an relatively inexperienced user.

SUMMARY OF THE INVENTION

The ditch digger of the present invention addresses the aforementioned needs in the art. Specifically, the ditch digger is of relatively simple design and construction so that the ditch digger is not unduly expensive, thereby allowing small contractors and subcontractors to purchase such a device and have the device on hand and readily available without the attendant costs of transporting the device between the rental house and the job site and without the worry of having a large piece of capital equipment sitting idle when the ditch digger is not in use. The ditch digger of the present invention is of relatively simple construction and is relatively easy to maintain and the ditch digger does not suffer frequent breakdowns. The ditch digger is relatively safe to operate even by an relatively inexperienced user.

The ditch digger of the present invention is comprised of a stock member that has a first section with at least one opening therein, and a second section that is disposed in angular fashion relative to the first section. A furrowing blade is attached to the second section of the stock member. A connector is attached to the first section of the stock member, the connector being receivable within a square hitch, which is itself attached to a vehicle proximate the vehicle's rear bumper, the square hitch having an aligned pair of openings. The connector is attached to the square hitch of the vehicle by providing an opening on the connector, aligning this opening with a pair of openings located on the square hitch, and passing a pin through these aligned openings. The connector comprises a rod member that is received within the square hitch and a pair of plates that are attached to the rod member in spaced apart fashion, the pair of plates having aligned openings thereon, such that the pair of plates straddle the first section and their aligned openings are aligned with a respective one of the at least one opening of the stock member and a pin is passed through these openings. Additional openings can be provided on the plates for changing the relative angle of the furrowing blade with respect to the rod member. A loop member is attached to the stock member.

BRIEF DESCRIPTION OF TEE DRAWINGS

Similar reference numerals refer to similar parts throughout the several views of the drawings.

DESCRIPTION OF THE PREFERRED EMBODIMENT

Figure 1:
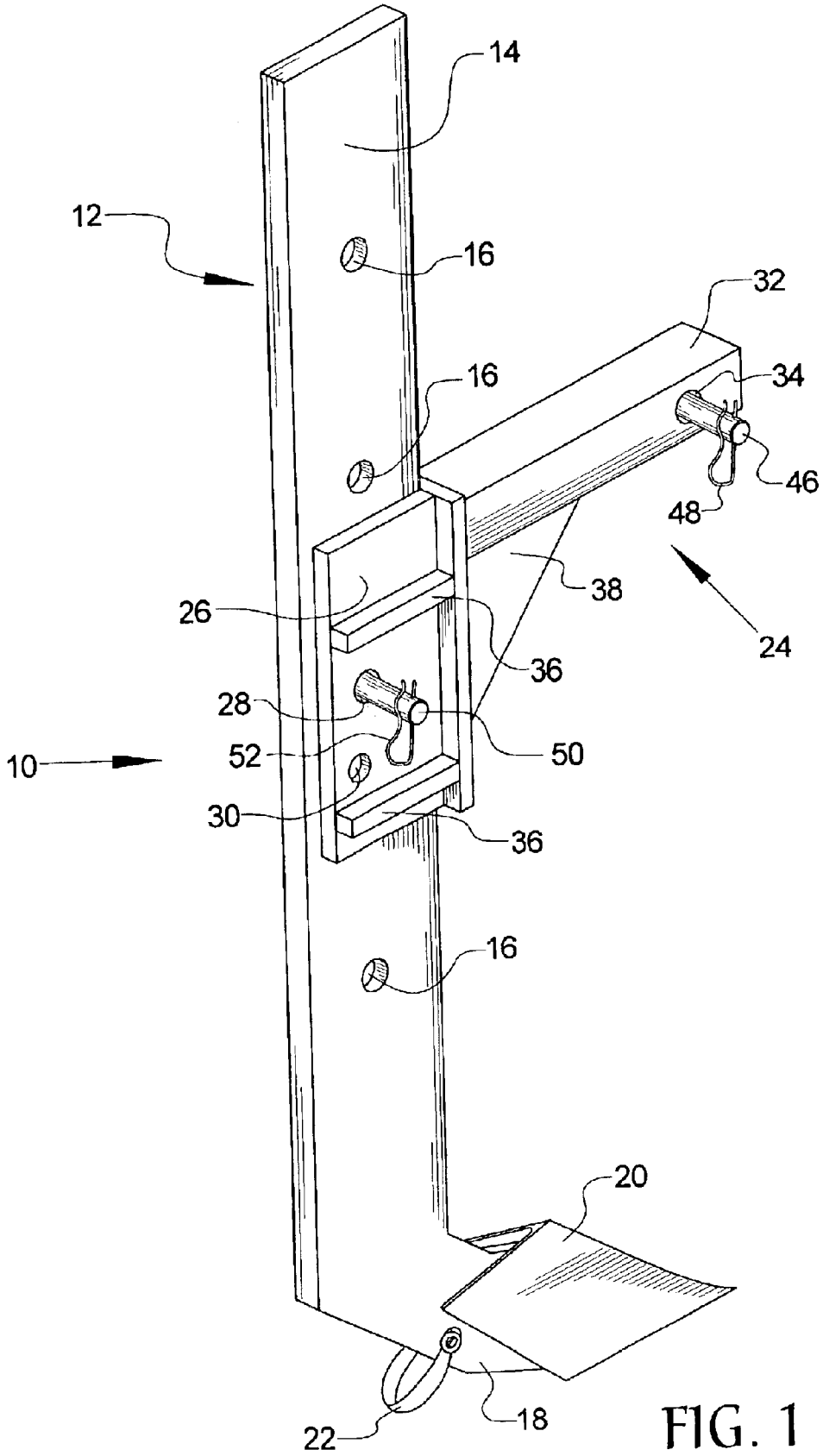
FIG. 1 is a front perspective view of the ditch digger of the present invention.
Figure 2:
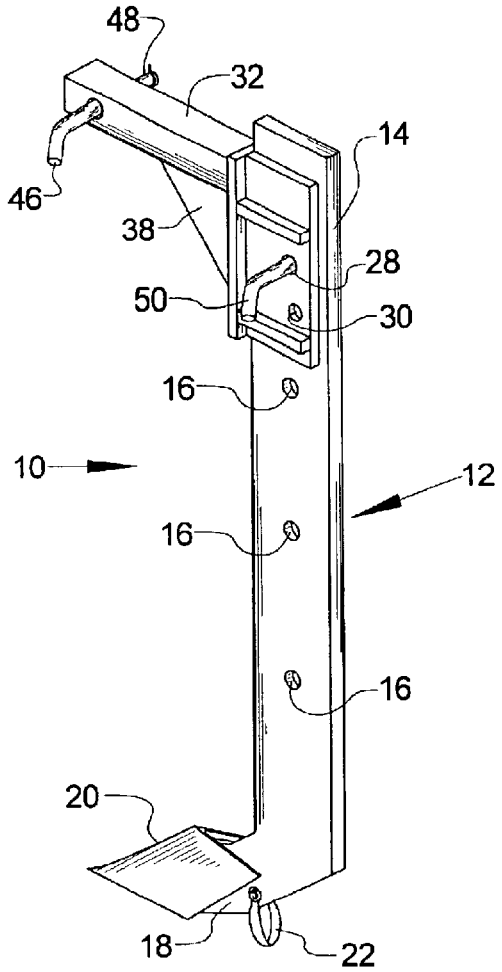
FIG. 2 is a rear perspective view of the ditch digger of the present invention.
Figure 3:
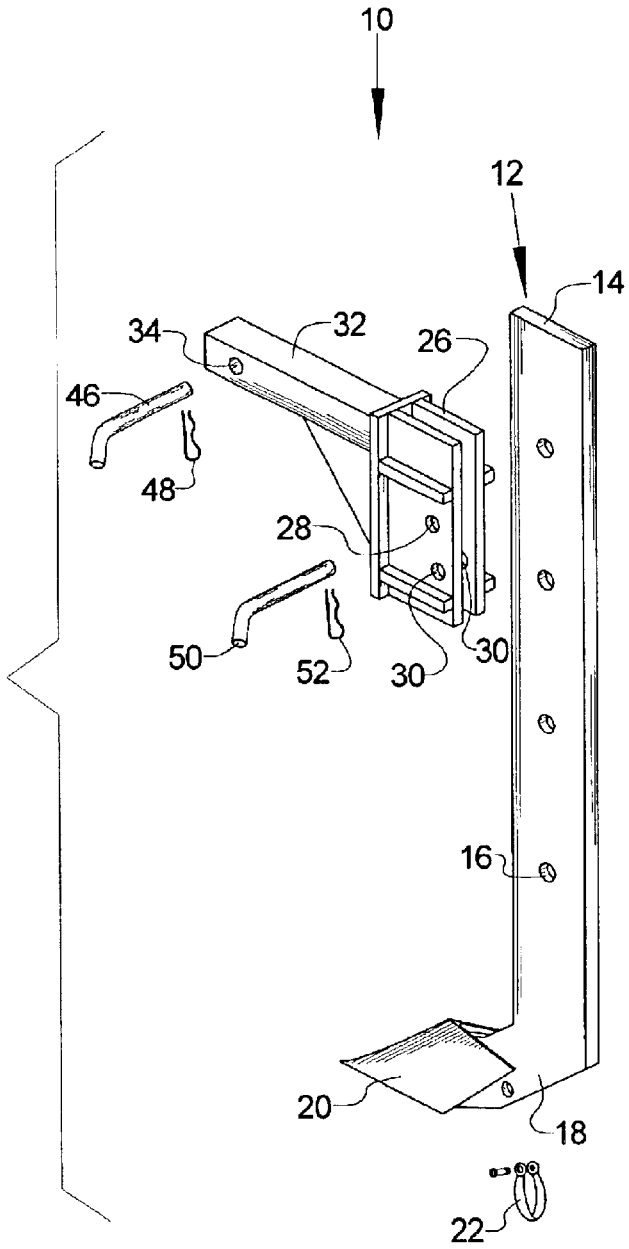
FIG. 3 is a rear perspective view, partially exploded, of the ditch digger of the present invention.
Figure 4:
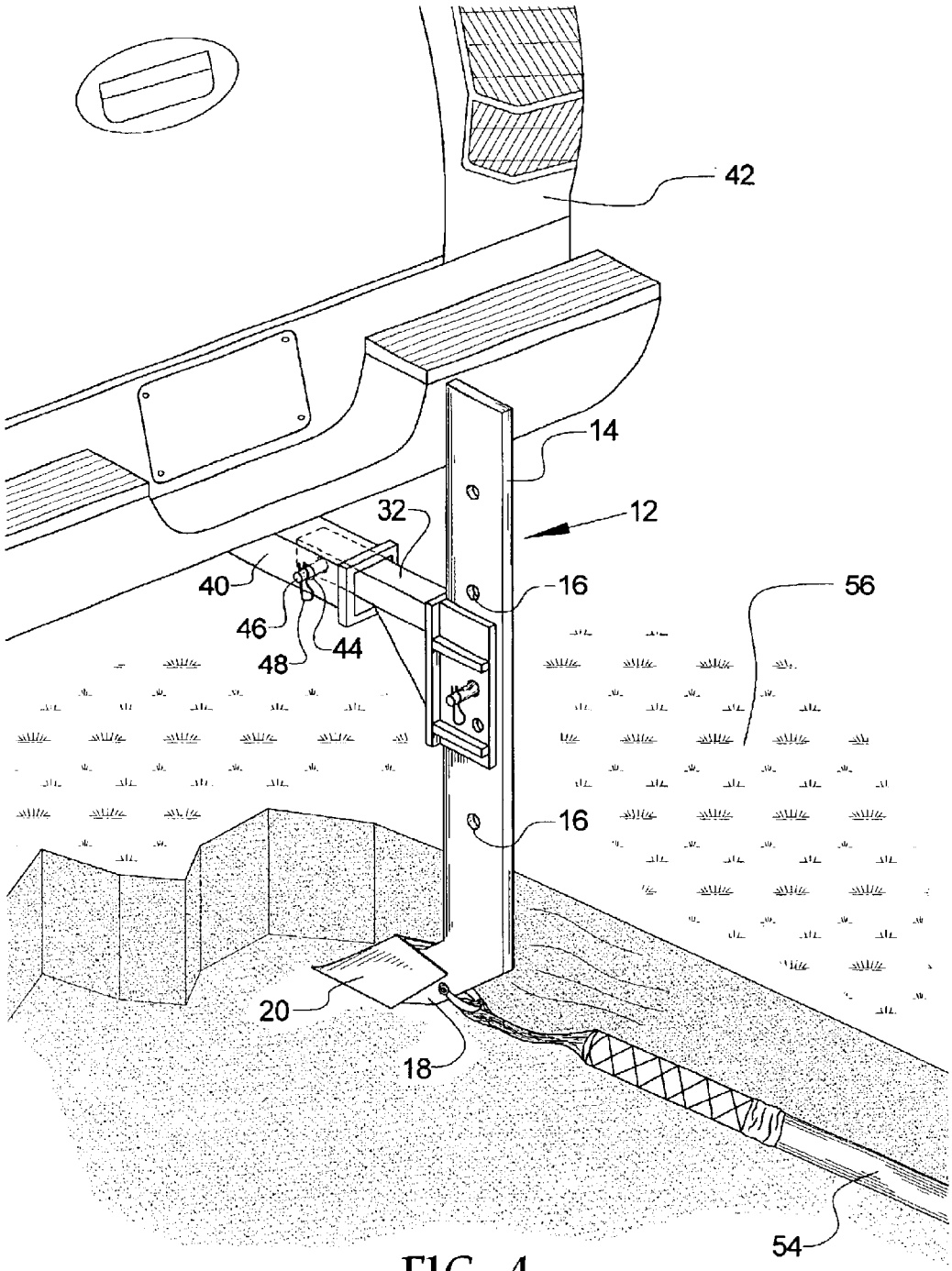
FIG. 4 is an environmental view of the ditch digger.

Referring now to the drawings, it is seen that the ditch digger of the present invention, generally denoted by reference numeral 10, is comprised of a stock member 12 that has a first section 14 with at least one opening 16 therein, and a second section 18 that is disposed in angular fashion relative to the first section 12. A furrowing blade 20 is attached to the second section 18 of the stock member 12. A loop member 22 is located on the stock member 12. The stock member 12 and blade 20 are made from an appropriate hard material such as metal.

A connector 24, which may also be made from metal, is attached to the first section 14 of the stock member 12. The connector 24 is comprised of a pair of coextensive plates 26, which each have aligned first openings 28 and second openings 30, the plates 26 being attached to a rod member 32 which has a pair of aligned openings 34 thereon. Appropriate rib members 36 can be used to aid in the structural rigidity of the plates 26 and a support bracket 38 can be used in the attachment of the plates 26 with the rod member 32. In order to use the ditch digger 10 of the present invention, the connector 24 is attached to the square hitch 40 of a vehicle 42, the square hitch 40 having a pair of aligned openings 44 thereon, by having the rod member 32 received within the square hitch 40 of the vehicle 42 until the openings 34 of the rod member 32 are aligned with the openings 44 of the square hitch 40. A pin 46 is passed through these aligned opening pairs 34 and 44 in order to facilitate the connection of the rod member 32 with the square hitch 40, a cotter pin 48 retaining the pin 46 in place.

The connector 24 is attached to the first section 14 of the stock member 12 by having the pair of plates 26 straddle the stock member 12 such that the either the first openings 28 or the second openings 30 of the plates 26 align with a respective one of the at least one opening 16 located on the first section 14 of the stock member 12. A pin 50 is passed through these aligned opening pairs 28 or 30 and 16 in order to facilitate the connection of the rod member 32 with the stock member 12, a cotter pin 52 retaining this pin 50 in place. As several vertically stepped openings 16 may be located on the stock member 12, the connector 24 may be height adjusted with respect to the stock member 12.

Additionally, as the first openings 28 and the second openings 30 are located on different planes, normal to the longitudinal axis of the rod member 32, the use of either the first openings 28 or the second openings 30 on the plates 26 of the connector 24 changes the pitch of the furrowing blade 22 relative to the rod member 32, depending on which openings 28 or 30 are selected.

An appropriately insulated wire 54 may be attached to the loop member 22 of the stock member in appropriate fashion. The vehicle 42 is driven over the area wherein the ditch is to be dug such that the furrowing blade 20 cuts through the earth 56. If the conduit 54 is attached to the loop member 22, the conduit 54 is laid within the ditch so dug immediately after the ditch is carved by the furrowing blade 20.

While the invention has been particularly shown and described with reference to an embodiment thereof, it will be appreciated by those skilled in the art that various changes in form and detail may be made without departing from the spirit and scope of the invention.

I claim:

1. A ditcher that is attached to a square hitch of a vehicle, the ditcher comprising:

a connector having a first end that is capable of being attached to the square hitch and a second end;

a stock member attached to the second end of the connector, the stock member having a first section with at least one first opening therein, and a second section that is located below the connector and that is disposed in angular fashion relative to the first section and such that the second section angles downwardly with respect to the connector and toward the first end of the connector;

a furrowing blade attached to the second section;

a loop member attached to the second section of the stock member immediately behind the blade; and wherein the connector is connected to the vehicle and the blade is pulled through the earth as the vehicle travels alone the earth and wherein a conduit is adapted to be attached to the loop member and to be pulled through the earth immediately behind the blade as the blade is pulled through the earth.

2. The ditcher as in claim 1 wherein the connector is attached to the first section of the stock member by providing a third opening on the connector, aligning the third opening with a respective one of the at least one first opening and passing a pin through the aligned third opening and the corresponding at least one first opening.

3. The ditcher as in claim 1 wherein the connector is attached to the square hitch of the vehicle by providing a pair of second openings on the square hitch and a third opening on the connector, aligning the third opening with the pair of second openings and passing a pin through the aligned third opening and the pair of second openings.

4. The ditcher as in claim 1 wherein the connector comprises:

a rod member that is received within the square hitch;

a pin; and a pair of plates attached to the rod member in spaced apart fashion, the pair of plates having aligned third openings, such that the pair of plates straddle the first section and the aligned third openings are aligned with a respective one of the at least one first opening and the pin is passed through the aligned third openings and the respective one of the at least one first opening.

5. The ditcher as in claim 1 wherein the connector comprises:

a rod member that is received within the square hitch;

a pin; and a pair of plates attached to the rod member in spaced apart fashion, the pair of plates having aligned third openings and aligned fourth opening, such that the pair of plates straddle the first section and either the third openings or the fourth openings are aligned with a respective one of the at least one first opening and the pin is passed through the aligned third openings or fourth openings and the respective one of the at least one first opening, such that the third openings are located on a first plane that is normal to the longitudinal axis of the rod member and the fourth openings are located on a second plane that is normal to the longitudinal axis of the rod member, the first plane and the second plane being in spaced apart orientation.

6. The ditcher as in claim as in claim 1 in combination with the conduit.

7. The ditcher as in claim 1 wherein the pitch of the blade with respect to the connector as the blade is being pulled through the earth can be changed.

8. A ditcher that is attached to a square hitch of a vehicle, the ditcher comprising:

a rod member having a first end that is received within the square hitch and a second end;

a pin:

a pair of plates attached to the second end of the rod member in spaced apart fashion: the pair of plates having aligned first openings and aligned second opening, a stock member having a first section, with at least one third opening such that the first section is received between the pair of plates and either the first openings or the second openings are aligned with a respective one of the at least one third opening and the pin is passed through the aligned first openings or second openings and the respective one of the at least one third opening such that the first openings are located forward on each plate relative to the rod member with respect to the second openings, the stock member also having a second section that has a furrowing blade attached thereto and that is located below the rod member and that is disposed in angular fashion relative to the first section and that angles downwardly with respect to the rod member and toward the first end of the rod member whenever the stock member is attached to the rod member; and wherein the rod member is connected to the vehicle and the blade is pulled through the earth as the vehicle travels along the earth and such that the pitch of the blade being pulled through the earth is different with respect to the rod member depending on whether the pin is inserted through the first openings and the respective one of the third openings or the second openings and the respective one of the third openings.

9. The ditcher as in claim 8 further comprising:

a loop member attached to the second section of the stock member immediately behind the blade; and wherein the rod member is connected to the vehicle and the blade is pulled through the earth as the vehicle travels along the earth and wherein a conduit is adapted to be attached to the loop member and to be pulled through the earth immediately behind the blade as the blade is pulled through the earth.

10. The ditcher as in claim as in claim 8 in combination with the conduit.

11. The ditcher as in claim 8 further comprising a loop member attached to the stock member.

12. The ditcher as in claim 8 further comprising a loop member attached to the second section of the stock member.

13. The ditcher as in claim 8 further comprising a brace extending between the pair of plates and the rod member.

* * * * *